US009623314B2

(12) United States Patent
Bray et al.

(10) Patent No.: US 9,623,314 B2
(45) Date of Patent: Apr. 18, 2017

(54) BALL COLLECTION SYSTEM AND PLAYING AREA

(71) Applicant: Courtflow Limited, London (GB)

(72) Inventors: Oliver Mark Tristan Bray, London (GB); Peter William Griffiths, Oxfordshire (GB)

(73) Assignee: Courtflow Limited, London (GB)

( * ) Notice: Subject to any disclaimer, the term of this patent is extended or adjusted under 35 U.S.C. 154(b) by 136 days.

(21) Appl. No.: 14/387,131

(22) PCT Filed: Mar. 22, 2013

(86) PCT No.: PCT/GB2013/050759
§ 371 (c)(1),
(2) Date: Sep. 22, 2014

(87) PCT Pub. No.: WO2013/140183
PCT Pub. Date: Sep. 26, 2013

(65) Prior Publication Data

US 2015/0087449 A1 Mar. 26, 2015

(30) Foreign Application Priority Data

Mar. 22, 2012 (GB) ..... 1205055.5

(51) Int. Cl.
*A63B 71/00* (2006.01)
*A63B 71/02* (2006.01)
(Continued)

(52) U.S. Cl.
CPC ..... *A63B 71/022* (2013.01); *A63B 47/025* (2013.01); *A63B 61/00* (2013.01)

(58) Field of Classification Search
CPC ..... A63B 47/00; A63B 47/02; A63B 47/025; A63B 71/022; A63B 61/00
(Continued)

(56) References Cited

U.S. PATENT DOCUMENTS 3,203,696 A * 8/1965 Sawyer ..... A63B 47/025 198/610
4,116,192 A 9/1978 Scott
(Continued)

FOREIGN PATENT DOCUMENTS

EP 0159275 A2 10/1985
FR 2565835 A1 12/1985
FR 2664171 A1 1/1992

*Primary Examiner* — Raleigh W Chiu
(74) *Attorney, Agent, or Firm* — Norton Rose Fulbright US LLP

(57) ABSTRACT

A ball collection system for a tennis court (1), configured to be provided along an edge (2*a*) of a tennis court, comprising: a first slope (11), extending along said edge of the tennis court, and configured such that the height of the first slope decreases in a first direction away from said edge of the tennis court; a second slope 12), arranged adjacent to the first slope on the opposite side of the first slope from the edge of the tennis court, and configured such that the height of the second slope decreases in a second direction, perpendicular to the first direction, from a first end that is no higher than the lowest part of the first slope to a second end; and a ball collector (14), arranged at the second end of the second slope and configured to receive balls that roll down the second slope.

20 Claims, 8 Drawing Sheets

(51) Int. Cl.
*A63B 47/02* (2006.01)
*A63B 61/00* (2006.01)

(58) Field of Classification Search
USPC ..... 473/460
See application file for complete search history.

(56) References Cited

U.S. PATENT DOCUMENTS

| | | | | | |
|---|---|---|---|---|---|
| 4,456,252 | A * | 6/1984 | Hartland | A63B 47/025 | 473/460 |
| 4,575,081 | A * | 3/1986 | Cavanagh | A63B 47/025 | 198/676 |
| 4,606,543 | A * | 8/1986 | Hartland | A63B 47/024 | 473/460 |
| 4,621,812 | A * | 11/1986 | Salansky | A63B 47/025 | 473/460 |
| 5,125,654 | A * | 6/1992 | Bruno | A63B 47/024 | 473/460 |
| 5,141,226 | A * | 8/1992 | Cavanagh | A63B 47/025 | 473/460 |
| 6,834,776 | B1 * | 12/2004 | Corvese | A63B 47/025 | 221/277 |
| 2006/0287137 | A1 | 12/2006 | Chu | | |
| 2015/0087449 | A1 * | 3/2015 | Bray | A63B 47/025 | 473/503 |

* cited by examiner

BALL COLLECTION SYSTEM AND PLAYING AREA

The present invention relates to a ball collection system, in particular for use with a tennis court and a playing area, for example including at least one tennis court provided on a playing surface and a ball collection system arranged to collect tennis balls.

Conventionally, a tennis court may be provided on a playing surface, namely a plurality of lines may be set out on the playing surface defining the tennis court. The edges of the tennis court may be defined at the ends by the so-called baselines and at the sides by so-called tramlines. Typically, the playing area further includes a section of the playing surface extending beyond the edges of the tennis court. Furthermore, a fence may be provided around the playing surface in order to define a boundary of the playing area and/or to prevent tennis balls from escaping beyond the playing area.

When tennis is played, either as a match, during friendly play of individual points, during practice or a coaching session, a tennis ball may escape the control of a player. For example, the tennis ball may be hit into the net across the centre of the tennis court, it may be miss-directed and leave the side of the tennis court or it may pass a player and pass beyond the end of the tennis court. Such a ball may end up in one of a number of places, such as anywhere along the bottom of the fence or anywhere within the playing area if, for example, the ball bounces back from the fence.

Depending on the situation, the ball may be collected so that play may be continued and/or a new ball may be used to continue play. For example, in a professional match, ball boys or ball girls may be provided to collect balls for the tennis players and/or provide new balls to them. Accordingly, a tennis ball is always made available to the players and no stray balls remain on the court. In less formal situations, the players may utilize a limited number of tennis balls, for example only a single tennis ball, and may pause briefly each time control of the tennis ball is lost to retrieve the ball before play continues. In such situations, the tennis players always have a tennis ball available and the tennis court may remain clear of loose balls. However, the players lose some time because they must constantly retrieve the tennis ball from wherever in the playing area it has come to rest.

In other situations, for example during tennis coaching sessions, it is undesirable to delay the coaching session while a tennis ball is retrieved. Accordingly, a large number of tennis balls may be provided from a supply. Accordingly, for example, a tennis player may practise their serve repeatedly without a significant delay between each serve. However, this may result in a large number of tennis balls becoming distributed around the playing area. Consequently, when the coaching session is finished, time is lost collecting all of the tennis balls. Furthermore, a number of tennis balls may end up on the playing area, possibly within the tennis court. This may increase the risk of an accident during play, for example caused by a tennis player accidentally stepping on one of the tennis balls, causing them to stumble or twist their ankle.

Therefore, it would be desirable to provide a system for collecting tennis balls.

According to an aspect of the invention, there is provided a ball collection system for a tennis court, configured to be provided along an edge of a tennis court, comprising: a first slope, extending along said edge of the tennis court, and configured such that the height of the first slope decreases in a first direction away from said edge of the tennis court; a second slope, arranged adjacent to the first slope on the opposite side of the first slope from the edge of the tennis court, and configured such that the height of the second slope decreases in a second direction, perpendicular to the first direction, from a first end that is no higher than the lowest part of the first slope to a second end; and a ball collector, arranged at the second end of the second slope and configured to receive balls that roll down the second slope.

Such a system may therefore collect all, or many of, the tennis balls that pass beyond the edge of the tennis court. For example, the ball collection system may be provided along one end of a tennis court such that any ball passing a player at that end of the court may be collected by rolling along the first and/or second slope until it is received at the ball collector. Accordingly, for example, a plurality of balls may be used, for example during a coaching session to practise serving as discussed above, and all, or substantially all, of the balls passing beyond the end of the tennis court may be collected to a single location, namely the ball collector. Accordingly, considerable time for the tennis player is saved and it may prevent balls remaining on the playing surface or significantly reduce their number.

In this respect, it should be appreciated that balls that strike the fence that may be provided around the playing area may drop back onto the first slope, for example. Accordingly, they may simply roll down onto the second slope and thereafter into the ball collector. However, if they bounce the angle of the first slope may result in the ball again bouncing onto the fence, and may roll down onto the second slope, rather than returning into the tennis court as happens with a conventional (horizontal) playing surface surrounded by a fence.

In the event that some balls remain on the playing surface, the ball collection system of the present invention may also assist in tennis ball collection. For example, a player may simply flick a tennis ball with no particular accuracy towards the ball collection system, which will therefore collect the ball into the ball collector. Accordingly, players may do so very quickly in a break in play. In the case of a coaching session, as discussed above, many balls will already have been collected by the ball collection system and the remaining balls, namely those remaining on the playing surface may be quickly collected by a series of such flicks, namely significantly more quickly and conveniently than walking about the playing surface manually collecting all of the tennis balls.

Furthermore, it will be appreciated that such a system may be very robust, namely may require no or almost no servicing or maintenance.

In one arrangement, the second slope may extend the full width of the first slope, for example such that the first and second ends of the second slope are provided at either end of the edge of the tennis court at which the ball collection system is provided.

Alternatively, a third slope may be provided that corresponds to the second slope and they may be arranged such that a ball rolling down the first slope may encounter either the second or the third slope depending on the position of the ball along the first slope. Accordingly, the width of the first slope may be divided between the second and third slope. Such an arrangement may be beneficial because it may be desirable to limit the height difference between the first and second end of the second slope (and therefore the third slope also, where used). If only the second slope is used, this may limit the maximum angle of the slope relative to horizontal (which is determined by the width of the first slope and the available height difference between the first and second ends of the second slope). By dividing the width of the first slope between second and third slopes, a greater angle relative to horizontal for the second and third slopes may be provided than if only the second slope is used. Increasing the angle relative to horizontal may encourage the tennis balls to roll down the slope, reducing the likelihood of a tennis ball entering the ball collection system but not being received at the ball collector.

In such an arrangement, the second and third slope may decrease in height in opposite directions such that the lower ends may meet at a common location at which a common ball collector may be provided. Such an arrangement may be advantageous because all of the balls ejected from the tennis court along one edge may be received at a single collector.

However, it will be appreciated that it is not essential for the second and third slopes to be arranged to share a common ball collector.

Accordingly, two ball collectors may be arranged at the respective second ends of the second and third slopes to receive balls that roll down the second and third slopes. Such an arrangement may be used, for example, if the second and third slopes are arranged to decrease in height in the same direction or if they are arranged to decrease in height in opposite directions but are arranged such that the respective first ends of the second and third slopes meet, namely the highest points are towards the middle of the width of the first slope.

It will be appreciated that the ball collection system may be provided along any edge of the tennis court, namely along one or both of the ends of the tennis court and/or along one or both of the sides of a tennis court.

In an arrangement, the highest point of the first slope may be level with the playing surface on which the tennis court is provided. Accordingly, all parts of the ball collection system may be below the level of the playing surface, avoiding the creation of trip hazards. It may be desirable, however, to provide a visual identifier of the provision of the first and/or second slope in order to make tennis players aware of the edge of the level playing surface.

In an arrangement, the first slope may extend from the edge of the tennis court along which it is provided.

Alternatively, the tennis court may be arranged on the playing surface such that a level section of the playing surface remains between the edge of the tennis court and the closest edge of the first slope of the ball collection system. Accordingly, a portion of the playing surface that is level with the tennis court may extend beyond the tennis court before the start of the first slope. This may be desirable, particularly at the ends of the tennis court because tennis players may stand outside of the tennis court during play and/or may need to run on a section of the playing surface beyond the edge of the tennis court.

It will be appreciated that, where plural ball collection systems are provided around a tennis court, different arrangements may be provided at different edges. For example, a section of the playing surface that is level with the tennis court may be provided beyond the ends of the tennis court before the provision of the ball collection systems associated with the ends of the tennis court but at the sides of the tennis court, where players do not routinely need to stand or run during play, the first slope may extend from the side of the tennis court.

It will be appreciated that the angles of the first and second slopes must be carefully selected. In particular, the slopes must be sufficiently steep relative to horizontal in order to encourage tennis balls to roll down the slopes and/or to encourage tennis balls bouncing on the slopes to remain within the ball collection system rather than bouncing back into the tennis court.

However, the size of the angle may be constrained by the maximum height drop that is desired to be provided. This is particularly the case for the second slope (and third slope, where used) in which the length of slope may be substantial, for example extending along the full length of the edge of the tennis court. In respect of the first slope, there may also be a limit on the size of the angle relative to horizontal that is provided in order to minimize the risk of stumbling for tennis players who run beyond the edge of the playing surface and onto the first slope.

Taking these factors into account, it has been found that the angle of the first slope relative to horizontal may desirably be within a range of from approximately 2° to approximately 15° and may, in a preferred embodiment, be approximately 10°.

Similarly, it has been found that the angle of the second slope (and, where used, the third slope), relative to horizontal may preferably be within a range of from approximately 1.5° to approximately 2.5°. In a preferred embodiment, the angle may be approximately 1.8°.

In the present invention, the length of the first slope, namely its dimension in the first direction, is within the range of from approximately 0.5 m to approximately 1.5 m. In a preferred embodiment, it may be approximately 0.9 m.

It will be appreciated that increasing the length of the first slope significantly increases the size of the ball collection system (the width of the first slope being defined by the length of the edge of the tennis court to which it is provided). Increasing the size of the ball collection system may increase the size of the playing area required for a tennis court and/or may reduce the space available for the playing surface, namely the level section of the playing area on which the tennis court is provided. On the other hand, increasing the length of the first slope increases the likelihood of a ball entering the ball collection system, for example balls bouncing back from a fence around the playing area, namely may increase the likelihood of any stray ball being collected into the ball collector. The above range of lengths is considered to be a suitable compromise.

The width of the second slope (and, where used, the third slope), namely the dimension of the second and/or third slope in the second direction may preferably be within a range of from approximately 69 mm to approximately 75 mm. In a preferred embodiment, the width of the second and/or third slope may preferably be approximately 70 mm. It will be appreciated that the width of the second and/or third slope must be sufficiently large to ensure that any conventional tennis ball may fall onto the second and/or third slope and may, thereafter, roll down the second and/or third slope. However, it will be understood that where the first slope adjoins the lower portions of the second and/or third slope, there will be a vertical drop from the edge of the first slope to the second and/or third slope. Therefore, it is desirable for the width of the second and/or third slope to be minimized in order to reduce the likelihood of a player running off the edge of a tennis court and getting their foot caught in the gap above a lower portion of the second and/or third slopes. Bright colouring of the second slope and third slope, where used, or similar visual highlighting, may be used to draw player's attention to the gap and may help prevent this.

In arrangements of the present invention, at least the first slope may be formed from the same material as the playing surface on which the tennis court is provided. This may reduce the cost of providing the ball collection system, which may be constructed at the same time as the playing surface on which the tennis court is provided. Similarly, the second and, where used, third slope may also be formed from the same material as the playing surface on which the tennis court is provided.

Alternatively, the second slope and/or, where used, the third slope may be formed from a different material from the playing surface on which the tennis court is provided. For example, a different material may be used because the tennis players are not expected to run on the second and/or third slope. Accordingly, it may be solely selected to maximize the likelihood of a tennis ball rolling down the second and/or third slope. This may be particularly desirable for the second and/or third slope because, as discussed above, the angle of the second and/or third slope relative to the horizontal may be constrained to be smaller than that of the first slope.

In a particular embodiment, the second and/or third slope may be formed from a pair of parallel bars or rods separated from each other by an appropriate distance such that a tennis ball is supported by the two parallel bars. It will be appreciated that such an arrangement of the second and/or third slope may present reduced resistance to rolling in comparison to a slope formed from a plain surface.

Furthermore, such an arrangement may also provide additional benefits. In particular, if the ball collection system of the present invention is provided outdoors, it will be necessary to consider drainage for any rain that falls on the ball collection system. If the arrangement in which the second and/or third slope is formed from a pair of parallel bars is used, rain water, including that which may drain from the first slope onto the second and/or third slope, may pass through the bars to a drainage system below the slope rather than passing down the second and/or third slope, in which case the rain water may collect in the ball collector, resulting in soggy balls.

According to a further aspect of the present invention, there is provided a playing area, comprising a playing surface on which at least one tennis court is provided, and at least one ball collection system according to any of the arrangements discussed above, provided along an edge of the playing area that corresponds to an edge of the at least one tennis court.

It should be appreciated that the playing area may include multiple tennis courts, in which case the ball collection system may be provided along the edges of the playing area such that multiple tennis courts may share the ball collection system. Alternatively, multiple ball collection systems may be provided along one or more edges of the playing area. As discussed above, the playing area may be configured such that the ball collection system may be provided along any edge of the tennis court, namely one or both of the ends of the tennis court and/or one or both of the sides of the tennis court.

In an arrangement, a playing area of the present invention may have at least two of the ball collection systems provided along respective edges of the playing area that meet at a corner. Accordingly, by appropriate arrangement of the second slopes of the two ball collection systems, the two ball collection systems may share a common ball collector. In particular, the ball collector may be arranged at the corner where the two edges of the playing area meet and the respective second slopes of the two ball collection systems may be configured such that balls rolling down either slope are received at the common ball collector.

Furthermore, as discussed above, in an arrangement the playing area may include a fence that surrounds, or partially surrounds, the playing surface and the one or more ball collection systems. Accordingly, it will be appreciated that such a ball collection system may be provided between the fence and the playing surface.

In an embodiment, the fence surrounding the playing area may specifically be damped in order to reduce the extent to which balls striking the fence bounce off the fence. This may increase the likelihood that tennis balls striking the fence will drop onto the ball collection system between the fence and the playing surface, namely land on the first slope or the second and/or third slope and thereby ultimately be received at the ball collector rather than bouncing back onto the playing surface including, for example, the tennis court.

In an embodiment, the ball collection may comprise a concave surface, extending from a curved upper edge, provided along an edge of the tennis court, to the ball collection system, provided at the lowest point of the concave surface.

The present invention will now be described by way of non-limiting examples, with reference to the accompanying drawings, in which.

Figure 1:
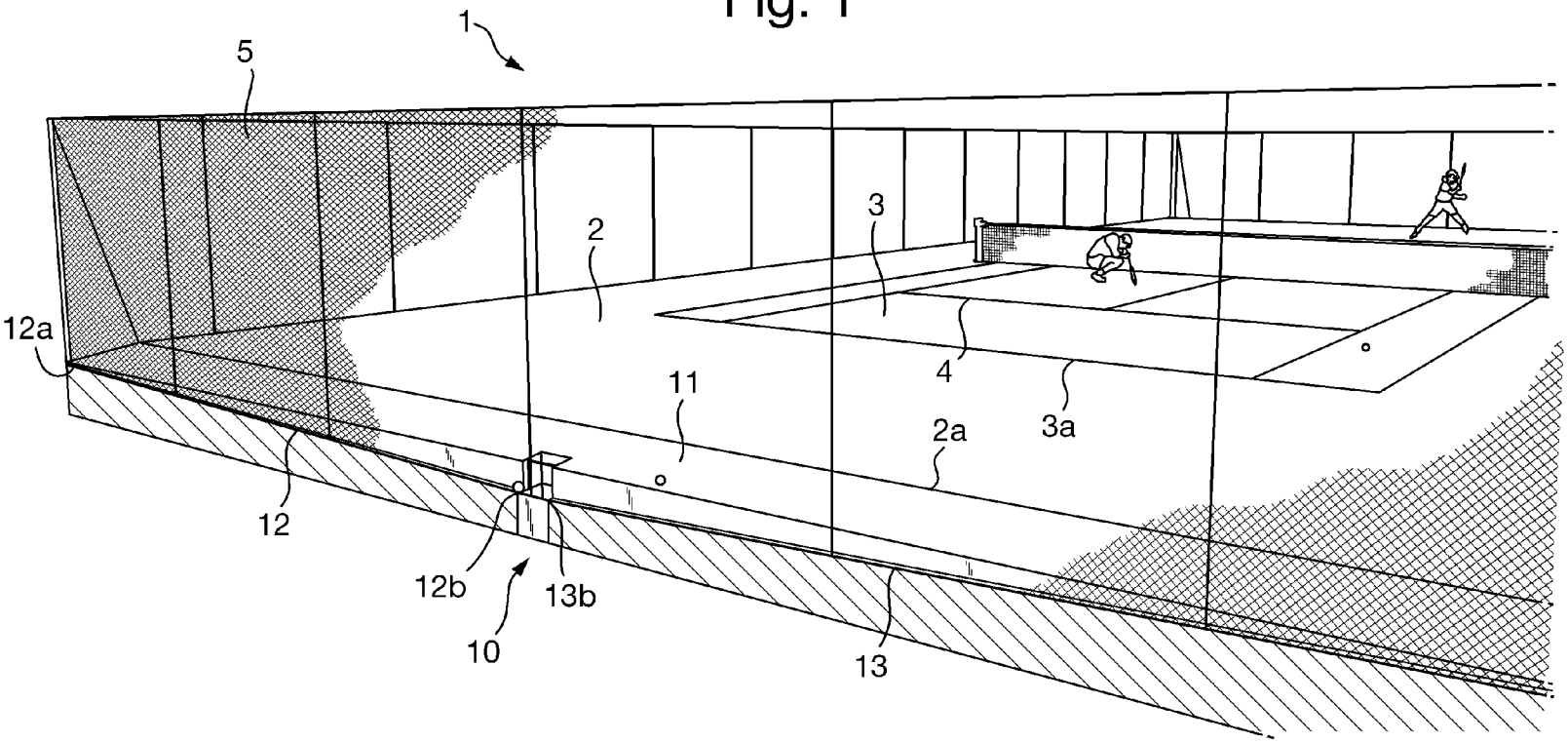
FIG. 1 depicts a ball collection system according to the invention.

FIG. 1 depicts a playing area 1 according to an embodiment of the present invention. As shown, the playing area 1 includes a horizontal playing surface 2, on which a tennis court 3 is defined by a plurality of lines 4. A fence 5 surrounds the playing area 1. However, it will be appreciated that, depending on the circumstances, the fence 5 may be provided on only one or a limited number of sides of the playing area.

As shown in FIG. 1, the playing area 1 further includes a ball collection system 10. This is depicted in further detail in FIG. 2. As shown, the ball collection system 10 is provided along an edge 2*a* of the playing surface 2, corresponding to an edge 3*a* of the tennis court 3.

The ball collection system includes a first slope 11 that slopes downwards away from the edge 2*a* of the playing surface. Accordingly, the height of the first slope 11 decreases in a first direction that is perpendicular to the edge 2*a* of the playing surface 2. Accordingly, any balls on the first slope 11 will roll away from the edge 2*a* of the playing surface 2. Beyond the first slope 11, namely on the opposite side of the first slope 11 from the playing surface 2, there is provided a second slope 12 and a third slope 13. These are both arranged to slope in a direction perpendicular to the first direction, namely to decrease in height in a direction perpendicular to the first direction. Accordingly, any balls on the second and third slopes 12,13 will tend to roll in a direction parallel to the edge 2*a* of the playing surface 2 at which the ball collection system 10 is provided.

Figure 2:
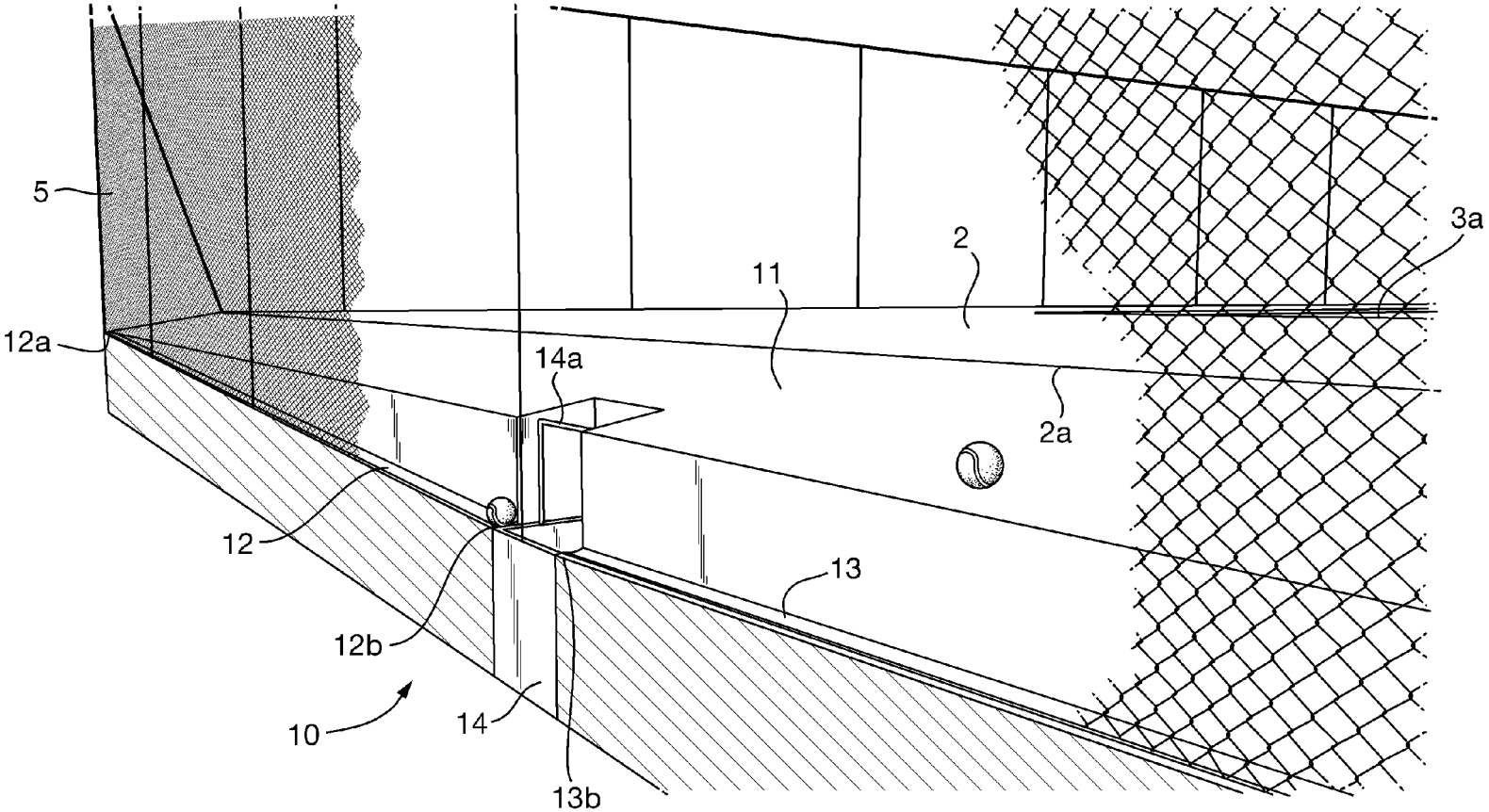
FIG. 2 depicts in greater detail a part of the ball collection system of FIG. 1.

In the arrangement depicted in FIGS. 1 and 2, the second and third slopes 12,13 are arranged to slope in opposite directions from respective first ends 12*a*,13*a* which are provided at the same level as the lowest parts of the first slope 11, to respective second ends 12*b*,13*b*. The second and third slopes 12,13 are arranged such that the second ends 12*b*,13*b* meet at a common ball collector 14 which may be, for example, a bucket, wire net, or other suitable container for collecting tennis balls. The ball collector 14 may be removable from the collection system 14 to enable easy removal of the tennis ball. A handle 14*a* may project from the ball collector 14 to facilitate removal of the ball collector.

FIGS. 1 and 2 depict a ball collection system of the present invention provided at one end of a playing area 1, namely that is configured to collect balls that pass beyond one end of the tennis court 3. It should be appreciated, however, that similar, or differently arranged, ball collection systems may be provided along any side of the playing area 1, corresponding to one or both of the ends of the tennis court 3 and/or one or both of the sides of the tennis court 3.

Furthermore, variations of the arrangement depicted in FIGS. 1 and 2 may be provided. For example, in place of the second and third slopes 12,13, a single slope may be provided that corresponds to an extended version of either the second or third slope 12,13. In that case, it will be appreciated that the ball collector 14 will be located at the corner of the playing area 1 corresponding to the lowest end of the slope. Furthermore, the second and third slopes 12,13 could be replaced by any desirable number of slopes in order to ensure that the angle of each slope can be provided in a desired range to encourage tennis balls to roll down the slopes into the collector(s).

Figure 7:
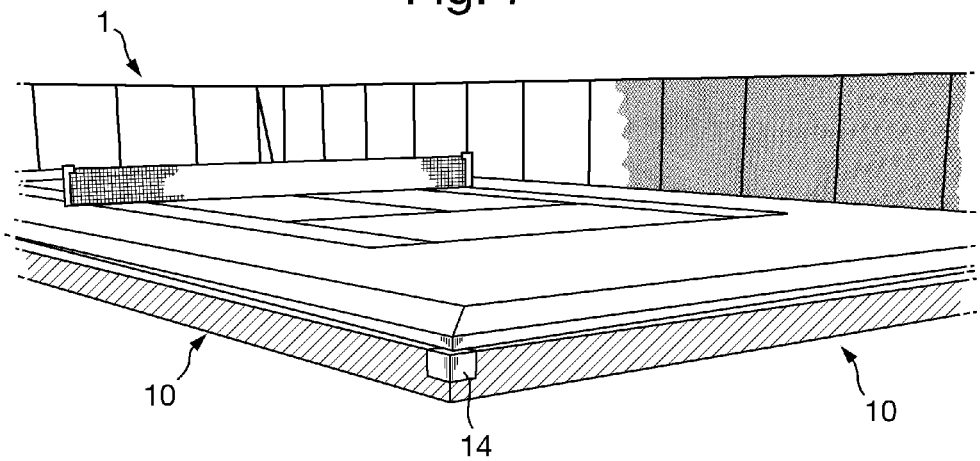
FIG. 7 depicts a further variant of the ball collection system of FIG. 1.

If a ball collection system is also provided along the adjoining edge of the playing area 1, namely the edge that connects to the same corner, the second ball collection system may also be configured to have a slope corresponding to the second or third slope 12,13, that feeds tennis balls into the same collector in the corner. Such an arrangement is depicted in FIG. 7, in which a ball collection system 10 arranged along one side of a playing area 1 shares a common collector 14 with a ball collection system 10 arranged along one end of the playing area 1. In such an arrangement, the common collector may be arranged at the adjoining corner, as shown.

Accordingly, it will be appreciated that if ball collection systems are to be provided on four sides of a rectangular playing area 1, it may only be necessary to provide ball collectors in each of the four corners.

If two or more tennis courts 3 provided on a playing area 1 are to share a common ball collector, either as part of a common ball collection system or as part of respective ball collection systems, the ball collector may include a divider, which may be removable, that may be used to separate the balls received from the different tennis courts. This may prevent different players balls being mixed.

In a further variation of the arrangement depicted in FIGS. 1 and 2, the second and third slopes 12,13 may be swapped, such that the highest ends 12*a*,13*a* of the second and third slopes 12,13 meet partway along the edge 2*a* of the playing surface, for example in the middle, and the lower ends 12*b*,13*b* of the second and third slopes 12,13 are provided in the corners of the playing area 1. If only a single ball collection system 10 is provided for a single edge 2*a* of the playing area 1, such an arrangement may be undesirable because it would be necessary to provide two ball collectors 14, one at each corner, in contrast with the arrangement depicted in FIGS. 1 and 2, in which a single ball collector is provided. However, as discussed above, if ball collection systems are to be provided at all four edges of a playing area 1, ball collection systems on respective edges that meet at a corner may share a common ball collector. Accordingly, in such an arrangement, it is only necessary to provide a ball collector 14 at each of the four corners of the playing area 1.

Figure 6:
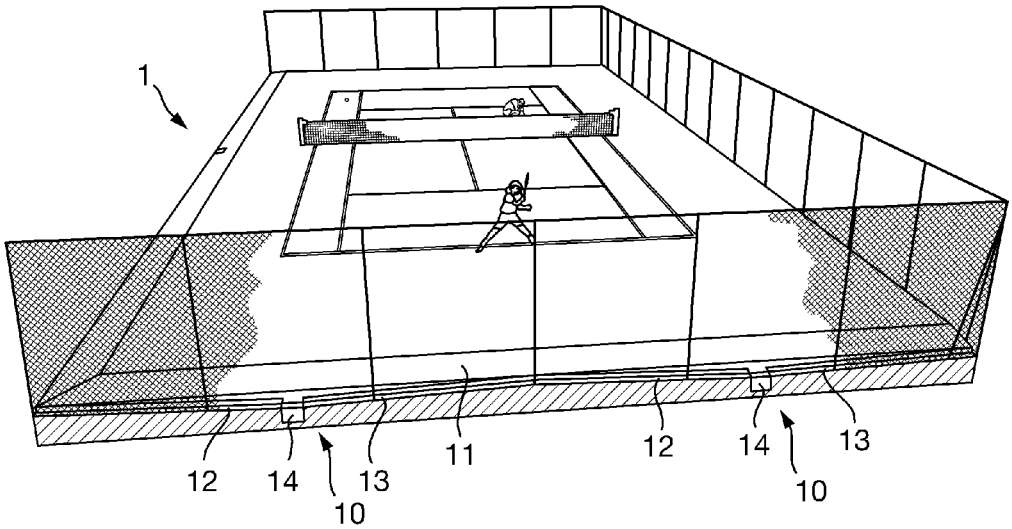
FIG. 6 depicts a variant of the ball collection system of FIG. 1.

In a further variation of the arrangement depicted in FIGS. 1 and 2, more than one ball collection system may be arranged along a single edge of a playing area 1. Such an arrangement is depicted in FIG. 6, in which two ball collection systems are provided along an end of the playing area 1. It will be appreciated that greater numbers of ball collection systems may also be used along a single edge of the playing area. As shown in FIG. 6, in such an arrangement, the ball collection systems may share a common first slope 11 but have separate respective second and third slopes 12,13 leading to separate respective ball collectors 14. Such an arrangement may permit the use of steeper slopes for the second and third slopes for a given depth of ball collector and a given length of the edge of the playing area.

Figure 3:
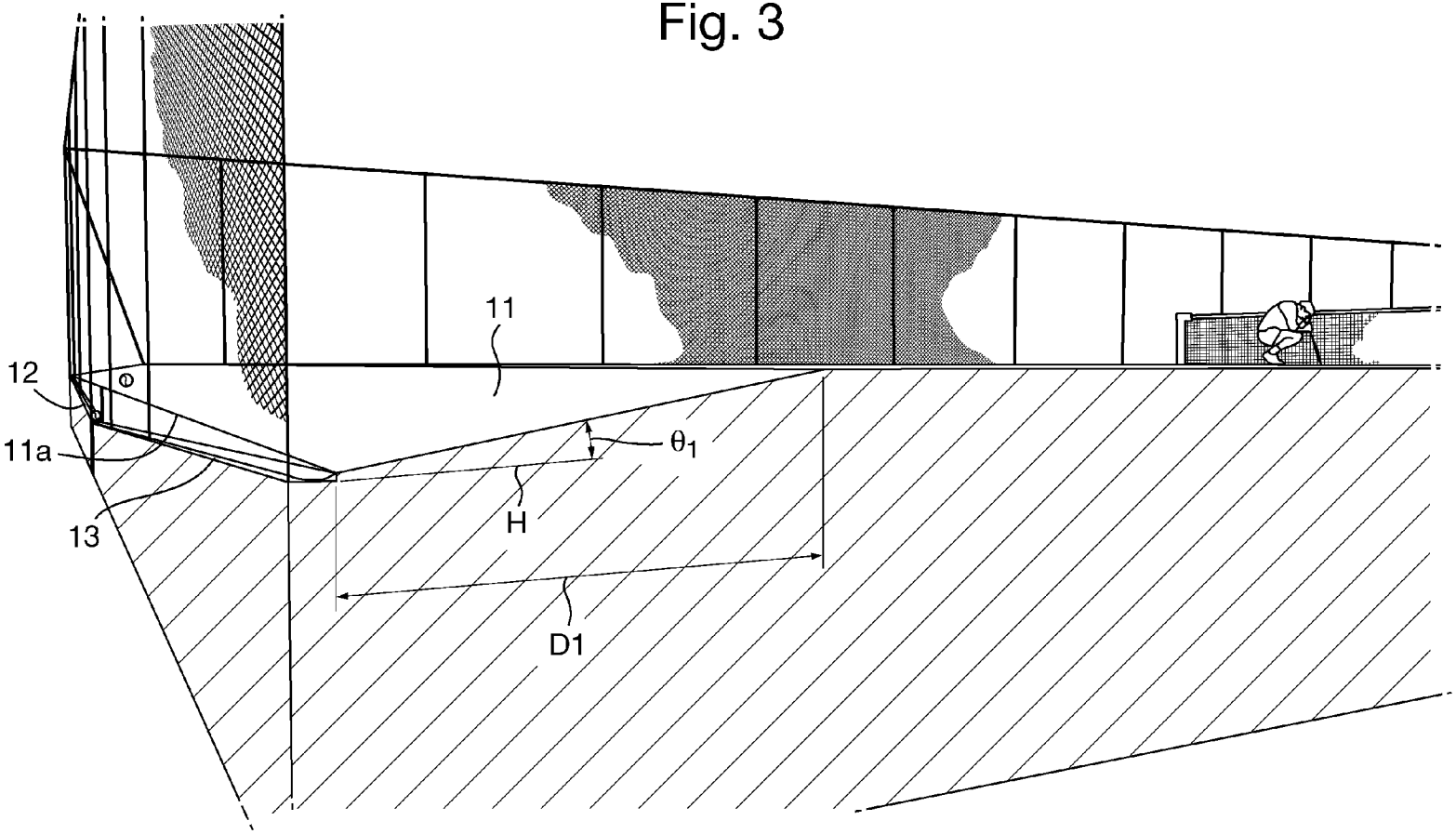
FIG. 3 depicts in greater detail a part of the ball collection system of FIG. 1.
Figure 4:
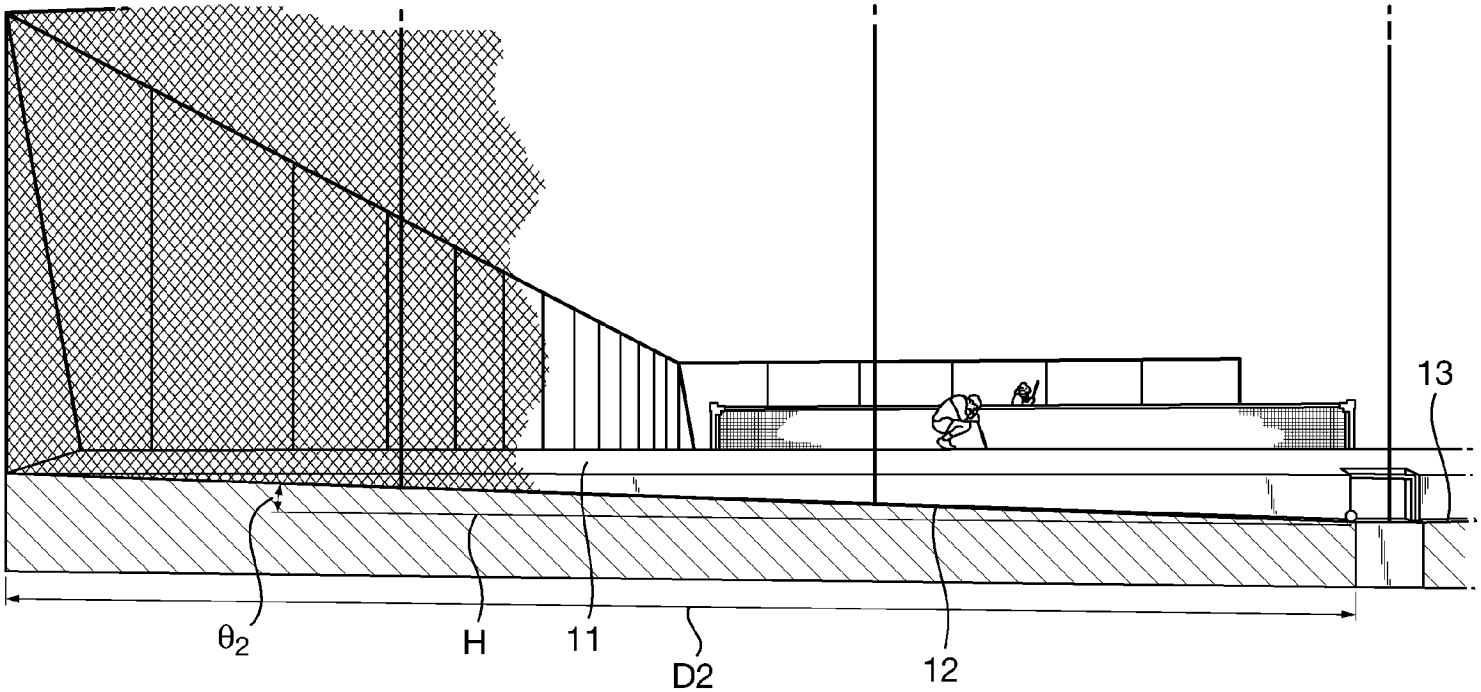
FIG. 4 depicts in greater detail a part of the ball collection system of FIG. 1.
Figure 5:
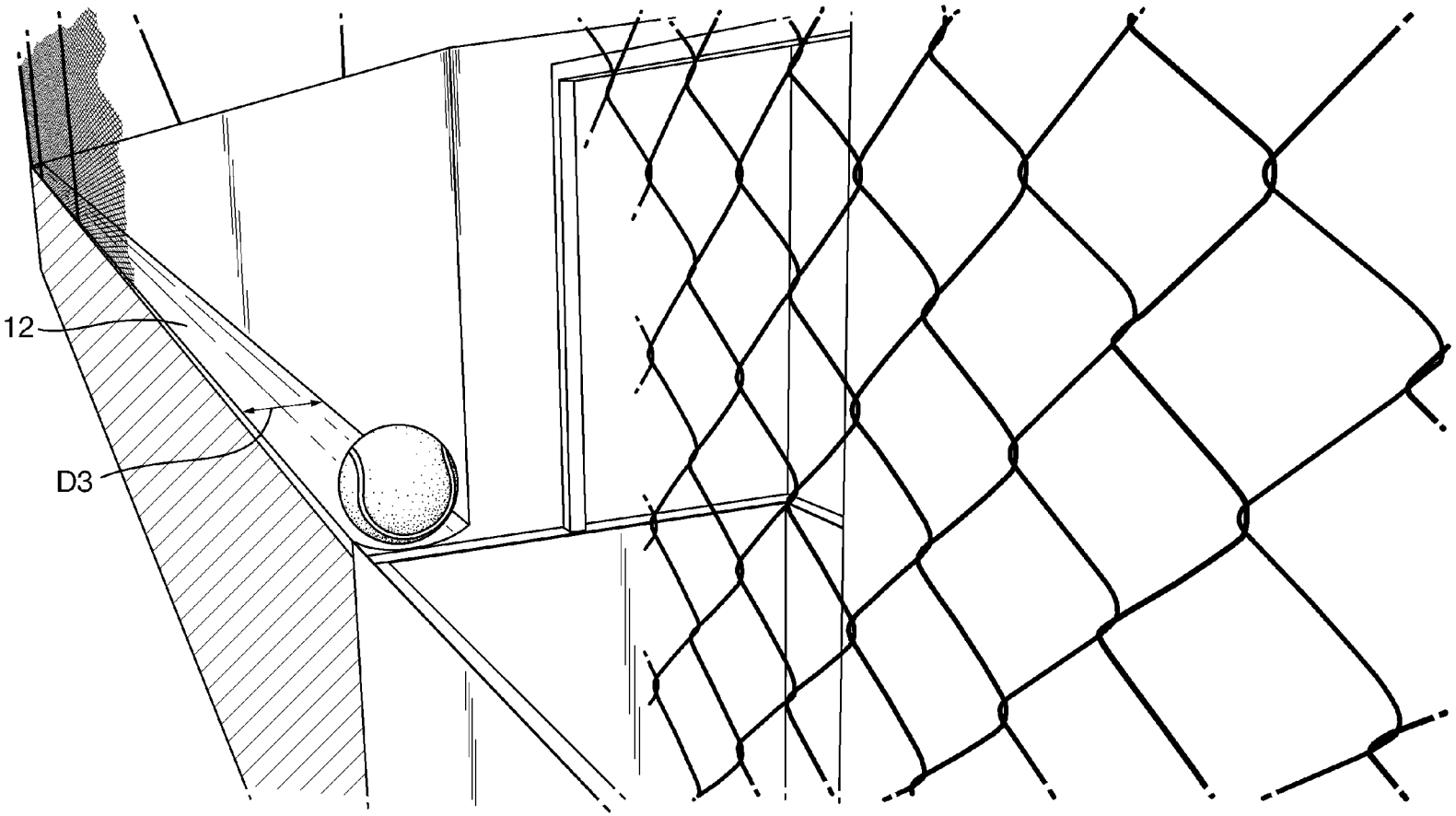
FIG. 5 depicts in greater detail a part of the ball collection system of FIG. 1.

FIGS. 3, 4 and 5 depict some further detail of the embodiment depicted in FIGS. 1 and 2. As shown, the first slope 11 may be arranged at an angle $\theta_1$ to the horizontal H of from approximately 2° to approximately 15°. In a particular embodiment, it may be at an angle $\theta_1$ of approximately 10° to the horizontal H. This is expected to be sufficient to ensure that tennis balls on the first slope 11 roll away from the playing surface 2 towards the second and third slopes 12,13. Once the balls reach the edge 11*a* of the first slope furthest from the playing surface 2, the tennis ball will drop onto either the first or second slope 12,13.

In an arrangement, the length D1 of the first slope 11 in the first direction, namely perpendicular to the edge 2*a* of the playing surface 2 at which the ball collection system 10 is provided may be approximately 0.5 m to approximately 1.5 m (when measured horizontally, as shown). In a particular embodiment, the length may be approximately 0.9 m. It is considered that this provides a sufficiently large area of the first slope 11 such that balls that strike the fence 5 may be expected to fall back onto the first slope 11 and therefore be retained in the ball collection system 10, whilst not significantly increasing the size of the playing area 1, for a given size of playing surface 2 or significantly reducing the size of a playing surface 2 for a given size of playing area 1.

The length D2 of the second and third surfaces 12,13 are fixed by the length of the edge 2*a* to which the ball collection system 10 is provided. It is further determined by the decision regarding whether to use an arrangement such as that depicted in FIGS. 1 and 2, in which second and third slopes 12,13 are provided, or to use an arrangement in which only one slope is provided beyond the first slope 11. In an arrangement such as that depicted in FIGS. 1 and 2, in which second and third slopes 12,13 are provided and the ball collection system 10 is provided to an end of the tennis court 3, the length D2 of the second and third slopes 12,13 when measured horizontally, may be just under 9 m.

It will be appreciated, however, that the angle $\theta_2$ of the second and third slopes 12,13, which will desirably be as large as possible to promote rolling of the balls down the slopes 12,13, will be determined by the length D2 of the second and third slopes 12,13 and the drop in height provided between the upper ends 12*a*,13*a* and lower ends 12*b*,13*b* of the slopes 12,13. The greater the height drop, the greater the angle but the greater the cost of providing the ball collection system 10 and the greater the inconvenience of removing the tennis balls from the ball collector 14, which must be provided below the lowest point of the second and third slopes 12,13.

It has been found that the second and third slopes may be provided at an angle $\theta_2$ relative to the horizontal, in the range of approximately 1.5° to approximately 2.5°. In an embodiment, the angle $\theta_2$ may be approximately 1.8°. This corresponds to a drop in height between the first ends 12*a*,13*a* and second ends 12*b*,13*b* of the second and third slopes 12,13 for an arrangement as above of approximately 0.23 m to 0.39 m, or approximately 0.28 m for the preferred embodiment.

The width D3 of the second and third slopes 12,13 should be minimized in order to minimize the size of the gap between the edge of the first surface 11 and the fence 5, if provided. Accordingly, the width D3 of the second and third slopes 12,13 should be only just larger than the maximum permissible size of the tennis ball but sufficiently larger to avoid jamming of a tennis ball, for example if there is movement of the fence 5. Accordingly, the width D3 of the second and third slopes 12,13 may be approximately 69 mm to approximately 75 mm. In a particular embodiment, it may be approximately 70 mm wide.

Any one of the first, second and third slopes 11,12,13 may be formed from the same material as the playing surface 2. In particular, this may be convenient for the first slope 11, which is immediately adjoined to the playing surface 2 and is sufficiently large that the players may run onto it whilst playing tennis. Accordingly, it is desirable that it should have a consistent level of friction. In contrast, the second and third slopes 12,13 may never be run on by the players. Accordingly, the second and third slopes may be specifically configured to promote rolling of the tennis ball along the slopes, without being constrained by providing a desirable surface for a player to run on. Furthermore, this may also be desirable because, as discussed above, the angle of the second and third slopes 12,13 may be significantly less than the angle.

It should be appreciated that the invention is not limited to the specified angles of the slopes discussed above and/or the dimensions discussed above. In particular, the desirable angles to be used, which will also determine the size of the slopes to be used, will depend upon the specific material to be used and the conditions under which it may operate. For example, a material for an outdoor court may be used in both dry and wet conditions, which may affect the rolling of a tennis ball down the slope. In any arrangement of the invention it may be appropriate to perform simple experiments with the surface materials that are desired to be used, under the expected conditions, in order to determine the appropriate angle for use.

Figure 8:
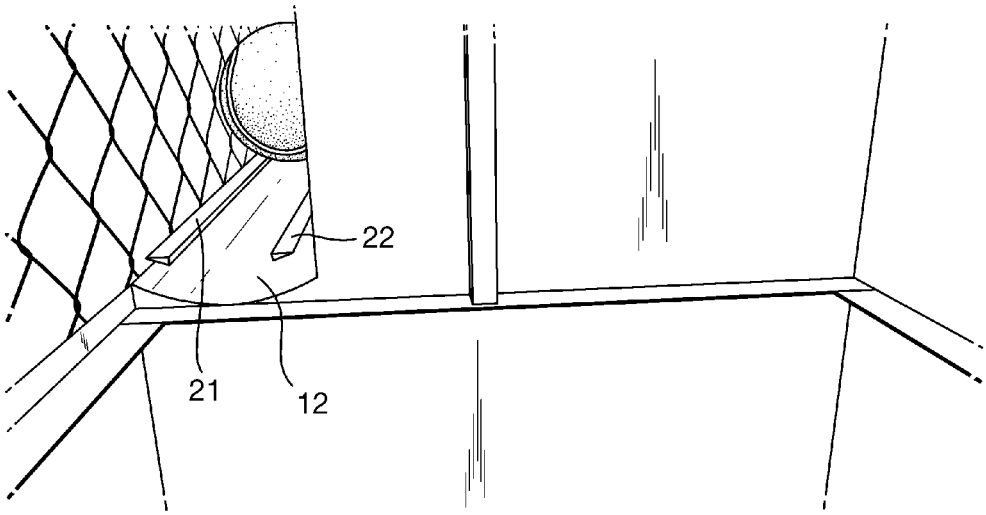
FIG. 8 depicts a variant of the ball collection system of FIG. 1.

In an embodiment, as depicted in FIG. 8, the second and/or third slopes 12,13, may be formed from a respective pair of rods 21,22 or such that a ball rolling down the second and/or third slopes is supported on a pair of rods 21,22 rather than the base surface. Within each pair of rods 21,22, the rods may be parallel and set apart by an appropriate distance such that the tennis balls are stably supported by the rods and will roll down the rods to the ball collector 14.

As depicted in FIGS. 1 and 2, the ball collection system 10 may be arranged such that there is a section of the playing surface 2 between the edge 3*a* of the tennis court 3 and edge 2*a* of the playing surface 2. Accordingly, there is space for a player to stand and run beyond the edge 3*a* of the tennis court 3 which is level with the tennis court 3. This may be particularly important at the ends of the tennis courts.

However, it should be appreciated that the playing surface 2 may only extend as far as the edge 3*a* of the tennis court 3. Accordingly, the edge 2*a* of the playing surface 2, at which the first slope 11 of the ball collection system 10 starts, may be provided at the edge 3*a* of the tennis court 3. Such an arrangement is more likely to be provided along the sides of a tennis court, where players do not stand. Accordingly, it may be sufficient to provide space along the sides of the tennis court 3 by means of the first slopes 11 of ball collection systems 10 provided along the sides of the tennis court 3.

In an embodiment, the fence 5 may be damped in order to reduce the bounce of a ball back from the fence. This may increase the likelihood of a ball being retained in the ball collection system 10 after it has struck the fence 5. In an embodiment, the fence may be damped by hanging damping materials onto the fence. For example, heavy plastic, which may be durable, may be hooked onto the fence, especially is a chain-link fence is used, for example.

As discussed above, in an embodiment, the ball collection system 10 may be arranged between the edge of the playing surface 2 and/or tennis court 3 and the position of the fence 5. However, in an embodiment, the fence 5 may be positioned at least partially above the ball collection system 10. For example, the lower edge of the fence 5 may be suspended above the ball collection system 10 at a height appropriate for balls to pass under the fence 5.

In an embodiment, the fence 5 may be provided above the interface between the first slope 11 and the second and/or third slopes 12,13. This may be arranged such that a tennis player running beyond the edge of the tennis court 3 may still run on to the first slope 11 but reduces the risk of a player placing a foot onto the second and/or third slope 12,13, reducing any possible risk of an injury caused at a location where there is a significant drop from the edge of the first slope 11 to the top surface of the second or third slope 12,13.

In such an arrangement, it may be desirable to provide an additional barrier beyond the edge of the second and/or third slope 12,13 in order to prevent any tennis balls from passing below the fence 5 and then going beyond the edge of the ball collection system 10.

Similarly, in an alternative or additional variation of the embodiment discussed above, the ball collector 14 may be partially or completely provided beyond the fence 5, namely on the opposite side of the fence 5 to the tennis court 3. In such an arrangement, the height of the fence 5 may be selected, locally if necessary, to ensure that tennis balls may pass below the fence 5 to reach the ball collector 14. Furthermore, in similar manner to that discussed above, an additional barrier may be provided beyond the ball collector 14 to ensure that tennis balls do not pass below the fence 5 and then beyond the ball collector 14.

In the embodiment discussed above, the ball collection system comprises at least two discrete slopes, the first slope 11 sloping in a first direction corresponding to the direction in which a tennis ball may travel when passing beyond the edge of the playing surface 2 and/or tennis court 3, and at least a second slope 12,13 that slopes in a perpendicular direction and functions to gather tennis balls rolling off the edge of the first slope 11 at one of a range of positions and guide them to a single point or region, namely the location of the ball collector 14. In an alternative embodiment, which may be combined with the variations discussed above where appropriate, in place of at least two discrete slopes, a single curved sloping surface may combine the function of both, namely to assist in transporting balls away from the edge of the playing area 2 or tennis court 3 and to gather the tennis balls together in a single point or region for collection.

Figure 9:
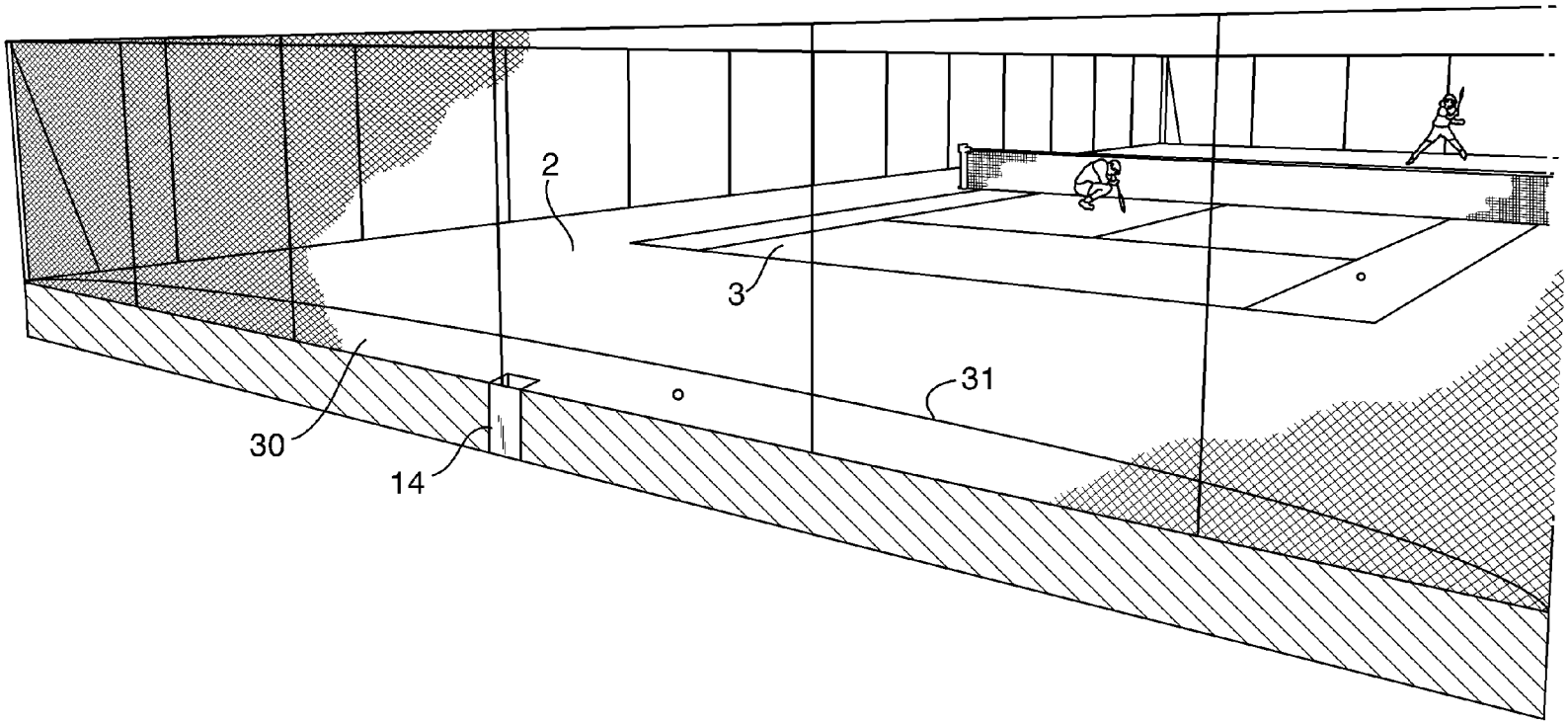
FIG. 9 depicts a ball collection system according to an embodiment of the invention.

FIG. 9 depicts an embodiment in which this is achieved by means of a concave surface 30. The concave surface 30 slopes down from a curved edge 31 provided at the edge of the playing area 2 and is configured such that regardless of the position along the curved edge 31 at which a tennis ball may start, a tennis ball will roll down to a common lowest point of the concave surface 30, at which the ball collector 14 may be provided.

The invention claimed is:

1. A ball collection system for a tennis court, configured to be provided along an edge of a tennis court, comprising:

a first slope, extending along said edge of the tennis court, and configured such that the height of the first slope decreases in a first direction away from said edge of the tennis court;

a second slope, arranged adjacent to the first slope on the opposite side of the first slope from the edge of the tennis court, and configured such that the height of the second slope decreases in a second direction, perpendicular to the first direction, from a first end that is no higher than the lowest part of the first slope to a second end; and a ball collector arranged at the second end of the second slope and configured to receive balls that roll down the second slope;

wherein the length of the first slope in the first direction is within the range of from 0.5 m to 1.5 m;

and the ball collection system further comprises a third slope, arranged adjacent to the first slope on the opposite side of the first slope from the edge of the tennis court, and configured such that the height of the third slope decreases parallel or anti-parallel to the second direction from a first end that is no higher than the lowest part of the first slope to a second end; and a second ball collector, arranged at the second end of the third slope such that it receives balls that roll down the third slope.

2. The ball collection system for a tennis court according to claim 1, wherein at the highest point of the first slope, it is level with a playing surface on which the tennis court is provided.

3. The ball collection system for a tennis court according to claim 1, wherein the first slope extends from the edge of the tennis court.

4. The ball collection system for a tennis court according to claim 1, further comprising a section of a playing surface on which the tennis court is provided that is at the same height as the tennis court and extends from the edge of the tennis court;

wherein the first slope extends from the edge of said section of the playing surface.

5. The ball collection system for a tennis court according to claim 1, wherein the angle of the first slope, relative to horizontal, is within the range of from 2° to 15°.

6. The ball collection system for a tennis court according to claim 5, wherein the angle of the first slope, relative to horizontal, is 10°.

7. The ball collection system for a tennis court according to claim 1, wherein the angle of the second slope and/or, where used, the third slope, relative to horizontal, is within the range of from 1.5° to 2.5°.

8. The ball collection system for a tennis court according to claim 7, wherein the angle of the second slope and/or, where used, the third slope, relative to horizontal, is 1.8°.

9. The ball collection system for a tennis court according to claim 1, wherein the width of the second slope and/or, where used, the third slope in the second direction is within the range of from 69 mm to 75 mm.

10. The ball collection system for a tennis court according to claim 9, wherein the width of the second slope and/or, where used, the third slope in the second direction is 70 mm.

11. The ball collection system for a tennis court according to claim 1, wherein at least one of the first slope, second slope and, where used, third slope is formed from the same material as the playing surface on which the tennis court is provided.

12. A ball collection system for a tennis court according to claim 1, wherein the second slope and/or, where used, the third slope is formed from a different material from the playing surface on which the tennis court is provided.

13. The ball collection system for a tennis court according to claim 1, wherein the length of the first slope in the first direction is 0.9 m.

14. A ball collection system for a tennis court, configured to be provided along an edge of a tennis court, comprising:

a first slope, extending along said edge of the tennis court, and configured such that the height of the first slope decreases in a first direction away from said edge of the tennis court;

a second slope, arranged adjacent to the first slope on the opposite side of the first slope from the edge of the tennis court, and configured such that the height of the second slope decreases in a second direction, perpendicular to the first direction, from a first end that is no higher than the lowest part of the first slope to a second end; and a ball collector arranged at the second end of the second slope and configured to receive balls that roll down the second slope;

wherein the length of the first slope in the first direction is within the range of from 0.5 m to 1.5 m;

wherein the second slope is formed from a pair of parallel bars, separated from each other by an appropriate distance to support a tennis ball.

15. A playing area, comprising a playing surface on which at least one tennis court is provided and at least one ball collection system is provided along an edge of the playing area that corresponds to an edge of said at least one tennis court;

wherein the ball collection system is configured to be provided along an edge of a tennis court and comprises:

a first slope, extending along said edge of the tennis court, and configured such that the height of the first slope decreases in a first direction away from said edge of the tennis court;

a second slope, arranged adjacent to the first slope on the opposite side of the first slope from the edge of the tennis court, and configured such that the height of the second slope decreases in a second direction, perpendicular to the first direction, from a first end that is no higher than the lowest part of the first slope to a second end; and a ball collector arranged at the second end of the second slope and configured to receive balls that roll down the second slope;

wherein the length of the first slope in the first direction is within the range of from 0.5 m to 1.5 m;

wherein the playing area comprises two of said ball collection systems, each provided along respective edges of the playing area that meet at a corner; wherein said two ball collection systems share a common ball collector, arranged at said corner.

16. A playing area according to claim 15, wherein at least a second tennis court is provided on said playing surface.

17. A playing area according to claim 15, wherein said edge of said tennis court is one of the ends and the sides of the tennis court.

18. A playing area according to claim 15, further comprising a fence adjacent the playing surface; wherein at least a part of said at least one ball collection system is provided between the fence and the playing surface.

19. A playing area according to claim 18, wherein the fence is configured to be damped such that balls striking the fence have a tendency to drop onto the ball collection system between the fence and the playing surface.

20. The playing area of claim 15, wherein the length of the first slope in the first direction is 0.9 m.

* * * * *